US005441789A

United States Patent [19]

Walker

[11] Patent Number: 5,441,789

[45] Date of Patent: Aug. 15, 1995

[54] ATTACHABLE TYPE BEACH TOWEL FOR UNIVERSAL USE

[76] Inventor: Gary A. Walker, 513 E. Toledo Pl., Broken Arrow, Okla. 74012

[21] Appl. No.: 183,815

[22] Filed: Jan. 21, 1994

[51] Int. Cl.[6] ..... B32B 3/14; B32B 3/06; A47C 27/00

[52] U.S. Cl. ..... 428/78; 428/82; 428/99; 428/100; 297/228.12; 297/223; 297/229

[58] Field of Search ..... 428/100, 99, 82, 78; 297/218, 219, 223, 229

[56] References Cited

U.S. PATENT DOCUMENTS

| | | | |
|---|---|---|---|
| 4,195,378 | 4/1980 | Parker | 428/100 |
| 4,223,056 | 9/1980 | Di Fronzo | 428/100 |
| 4,518,198 | 5/1985 | Daniels | 297/229 |
| 4,553,785 | 11/1985 | Duke et al. | 297/229 |
| 4,627,363 | 12/1986 | Jones | 428/100 |
| 4,634,618 | 1/1987 | Greer et al. | 428/100 |
| 4,725,094 | 2/1988 | Greer | 297/229 |
| 4,844,540 | 7/1989 | Pegram | 297/229 |
| 4,856,912 | 8/1989 | Damus et al. | 428/100 |
| 4,892,353 | 1/1990 | Goddard | 297/224 |
| 5,023,125 | 6/1991 | Gray | 428/100 |
| 5,028,472 | 7/1991 | Gray | 428/100 |
| 5,084,321 | 1/1992 | Sui | 428/100 |

*Primary Examiner*—George F. Lesmes
*Assistant Examiner*—Terrel Morris

[57] ABSTRACT

A attachable type beach towel and chair cover combination for being attached to virtually all types of outdoor seating apparatus, comprising: a elongated substantially rectangularly shaped main body portion of textile fabric beach towel (10) having a pair of side edges and a pair of ends. At the ends are four attaching straps (12) permanently attached at end portions and spaced inwardly from the side edges and four corresponding attaching tabs (14) permanently attached to main body of the beach towel (10) spaced inwardly from the side edges and end portions. The attaching straps (12) and the attaching tabs (14) will be of the hook and loop type fastening system. Two attaching straps (12) and two corresponding attaching tabs (14) will be on opposite sides of the central axis parallel to the side edges and to the central axis parallel to the ends of the beach towel (10), thus making the location of each attaching strap (12) and its corresponding attaching tab (14) generally symmetrical to the others. Included will be four peel and stick attaching tabs (16) which will be of the component of the hook and loop type fastening system that corresponds with the permanently attached attaching straps (12). The four peel and stick attaching tabs (16) will be adhered to the appropriate locations designated by the location of the attaching straps (12) when the attachable type beach towel and chair cover combination is laid out on the type of seating apparatus where there is no frame or strapping to attach to.

8 Claims, 4 Drawing Sheets

ATTACHABLE TYPE BEACH TOWEL FOR UNIVERSAL USE

BACKGROUND—FIELD OF INVENTION

A beach towel and chair cover combination capable of being attached to virtually all types of outdoor and indoor seating apparatus.

BACKGROUND—DESCRIPTION OF PRIOR ART

Most people, who are sunbathing, swimming or boating, place a towel on their chair for comfort to keep the plastic webbing or vinyl cover from becoming hot and to absorb perspiration. A gust of wind, however, can blow the beach towel away when the sunbather leaves the chair. Even when sitting in the chair the towel tends to slip down the back of the chair, bunching up and becoming tangled when the sunbather leans forward or adjusts position. In the attempt to temporarily solve this inconvenience the sunbather usually tries to keep the beach towel ends tucked into some part of the seating apparatus.

Although the effort of keeping the beach towel in place by tucking the ends into the seating apparatus can temporally solve the problem, it more than likely is short lived as when next time you adjust your position or get out of the chair the towel comes loose.

Thereafter, inventors have created several types of attachable beach towels designed to be attached to specific types of outdoor seating apparatus to which they were specifically designed. U.S. Pat. No. 4,844,540 to Pegram (1988) discloses a beach towel designed to be attached to a lounge chair type seating apparatus, however, this design does not take into consideration all the other various types, shapes and sizes of seating apparatus. U.S. Pat. No. 4,892,353 to Goddard (1989) shows a beach towel of specific design to be attached only to a lounge chair of a specific type by means of elasticized panel and bands. U.S. Pat. No. 4,725,094 to Greer (1987) this design is one of use with a sand or lawn chair and therefore has no means of being used in a universal way in regards to all the various types of seating apparatus. U.S. Pat. No. 4,518,198 to Daniels (1981) and U.S. Pat. No. 4,553,785 to Duke and Pierce (1983) are designs for use with a specific type seating apparatus, so as to be rendered useless as far as being attachable to virtually all types of outdoor and indoor seating applications.

Although these various types of attachable beach towels do address the problem of keeping the towel in place, their specific design makes for limited and restricted use. Thus if the towel were to be used in the various applications to which a sunbather may encounter such as boat seats, lounge chairs, deck chairs and even covering their car seat when their still wet from swimming, it would take a universal type design of attachable beach towel to allow for use in such a broad range of types, shapes, and sizes of seating apparatus. This universal type towel must possess certain characteristics as to its use being of a simple design so as its function is easily understood, it must also be able to be attached and removed in an easy and rapid fashion. My own design of attachable type beach towel possesses all these needed characteristics so as to appeal to millions of consumers, but nevertheless all the other type attachable beach towels heretofore known suffer from a number of disadvantages:

(a) By and large the manufacturing processes involved in their construction involves extensive placement and sewing operations so as to be a precise fit for the type seating apparatus they were designed for. Thus creating the potential of a cost factor as compared to the non-attachable type beach towel.

(b) In most cases of the above prior art listed, their design is not one of the greatest simplicity as to be easily understood by the layman, as to how it fits, what it fits, and how easily it can be attached and removed.

(c) If one were to sunbathe in a variety of locations such as by a swimming pool, beach, lake or in a boat the types of seating apparatus would vary as to type, shape, and size rendering the prior art unusable for its attachable capabilities except for those situations where the type of seating apparatus the towel was designed to fit was available.

(d) The question must be raised as to the durability of such designs as in the prior art in that they are frequently exposed to chlorine and other pool chemicals they often get wet and are exposed to the sun for long periods of time. With the fitted design that most of them possess this creates an obvious strain on seams with no ability to release itself other than to tear.

OBJECTS AND ADVANTAGES

Accordingly, several objects and advantages of the attachable beach towel being disclosed wherein this patent application are as follows:

(a) The universal applications of my beach towel invention as in it is attachable and is easily released from virtually all types, shapes and sizes of outdoor and even indoor seating including deck chairs, sand chairs, lounge chairs, boat seats, car seats, and patio and lawn furniture.

(b) It is easily removed from any type seating apparatus in the event it is needed to dry yourself off, or be moved to another location or type of seating.

(c) It can be used in any manner in which a non-attachable type beach towel is used, in that it is very similar in appearance to conventional beach towels as far as shape and size, except that it has the capability to be attached to virtually all types of seating.

(d) The invention is of such simple design that anyone can use it and understand its function and application as to the various types of seating apparatus it will be attached to.

(e) There are no special or time consuming manufacturing processes involved in the manufacture of my attachable beach towel by which a substantial cost factor would be encountered, thus making it appealing to the consumer.

(f) There are no special requirements for the care and handling of said invention as it is machine washable and is attachable in such a way as it will pull loose from the seating apparatus it is attached to in the event it is pulled in such a way as to damage any of its components.

Further objects and advantages are to provide an attachable type beach towel that can be used easily and conveniently to solve the problem of keeping the towel in place while also keeping it simple and inexpensive to manufacture. Further objects and advantages of my invention will become apparent from further consideration of the drawings and ensuing descriptions.

DRAWING FIGURES

In the drawings, closely related figures have the same number but different alphabetic suffixes.

REFERENCE NUMERALS IN DRAWINGS

| | | | |
|---|---|---|---|
| 10 | beach towel | 20A | body support strap |
| 12 | attaching straps | 20B | body support strap |
| 14 | attaching tabs | 22A | body support panel |
| 16 | peel and stick attaching tabs | 22B | body support panel |
| 18A | upper horizontal rail | 24 | lower horizontal rail |
| 18B | upper horizontal rail | | |

DESCRIPTION—FIG. 1

Figure 1:
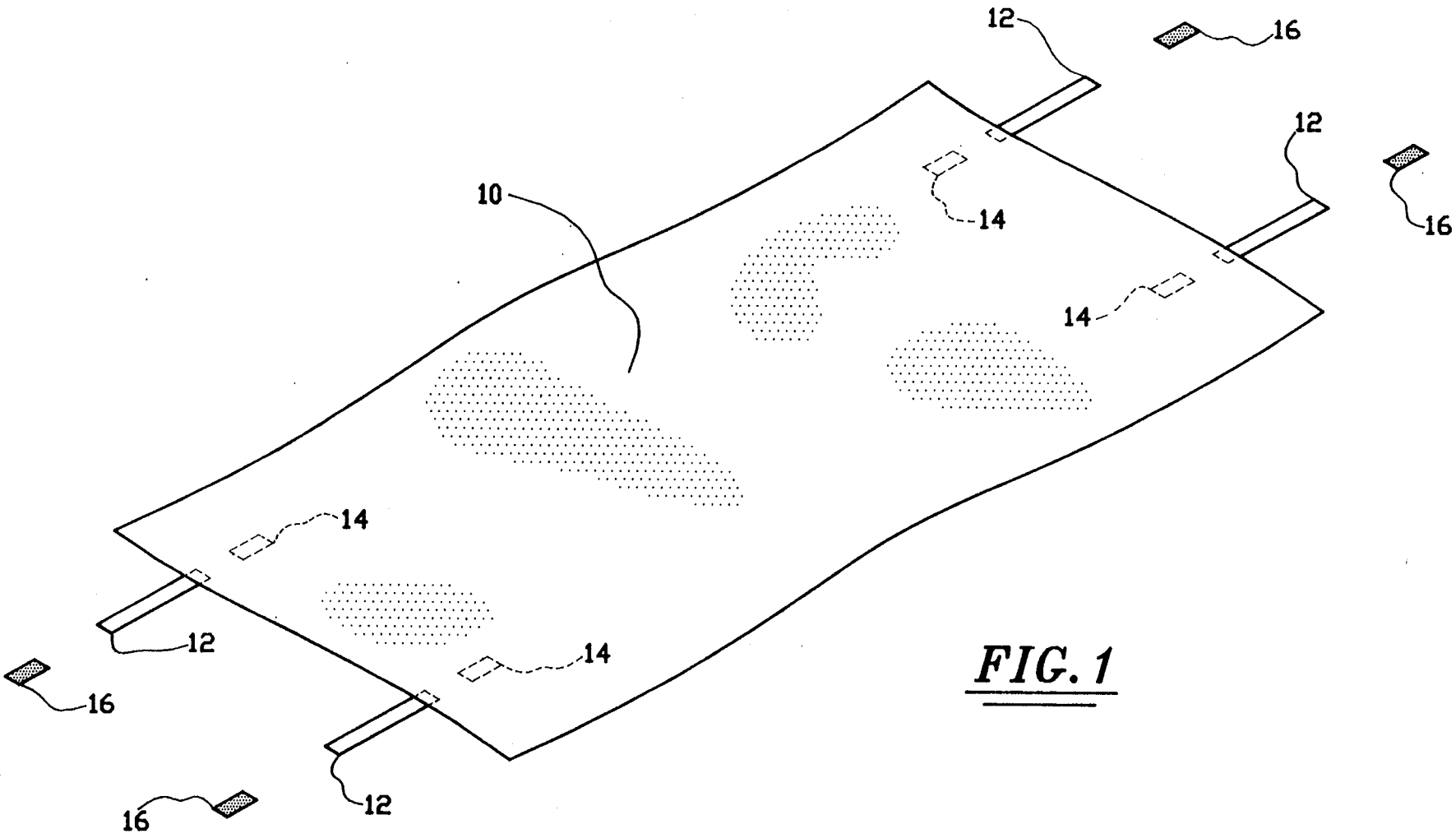
FIG. 1 shows the attachable type beach towel of the present invention and all of its components required to make it functional for universal use.

A typical embodiment of the attachable type beach towel of the present invention is illustrated in FIG. 1. The attachable type beach towel has an elongated substantially rectangularly shaped main body portion of textile fabric beach towel 10 having a pair of side edges and a pair of ends, size being that of the industry standards. However the size of the attachable type beach towel is not limited to specific industry standards in that the attachment components do not rely on industry standard sizes to be functional.

At the ends of the attachable type beach towel are four "VELCRO" type attaching straps 12 permanently attached at end portions and spaced inwardly from side edges of the beach towel 10, and four corresponding "VELCRO" type attaching tabs 14 permanently attached to main body of the beach towel 10 spaced inwardly from side edges and end portions. Two attaching straps 12 and two corresponding attaching tabs 14 will be on opposite sides of a central axis parallel to the side edges and to the central axis parallel to the ends of the beach towel 10, thus making the location of each attaching strap 12 and its corresponding attaching tab 14 generally symmetrical to the others.

The attaching straps 12 are typically 25.4 mm (1") in width and have a length dimension of roughly 165.1 mm (6.5"). As in all "VELCRO" type fasteners their is a hook component and a corresponding loop component in which to create the fastening capabilities they possess. In the attachable type beach towel of present invention the attaching straps 12 will be of the loop component of the "VELCRO" type fastener (the brand name of "VELCRO" will be used throughout this patent application for clarity, as it is general practice to associate the brand name "VELCRO" to all other manufactures of hook and loop type fasteners. However the attaching components in present invention will not be limited to the specific brand name of "VELCRO". The attaching straps will be located roughly 177.8 mm (7") outward from central axis parallel to the pair of sides. Creating a total distance between each set of attaching straps 12 at each end of the beach towel 10 of roughly 355.6 mm (14") utilizing roughly 12.7 mm (0.5") of attaching strap 12 for overlapping with ends of the beach towel 10 to allow for permanent attachment to the beach towel 10.

The corresponding attaching tabs 14 are typically 25.4 mm (1") in width and have a length dimension of roughly 50.8 mm (2"). The corresponding attaching tabs will be of the hook component of the hook and loop type fastener. The attaching tabs will be attached to the beach towel 10 by which the long sides of the attaching tabs 14 is parallel to the pair of sides of the beach towel 10. The attaching tabs will be located roughly 88.9 mm (3.5") inward from the ends of the beach towel 10 and roughly 177.8 mm (7") outward from central axis parallel to the pair of sides. Creating a total distance between each set of attaching tabs 14 at each end of the beach towel 10 of roughly 355.6 mm (14").

The attaching straps 12 and corresponding attaching tabs 14 will be permanently attached to the beach towel 10 in their designated locations by means of a sewing process using a polyethylene monofilament thread. This thread is used for its strength and durability tendencies in that it stands up well under the conditions in which a beach towel is subjected, including pool chemicals, salt water, and heavy exposer to the sun. In addition this polyethylene monofilament thread comes transparent in color so as to be used for permanently attaching the various colors of "VELCRO" type fasteners to the various designs and colors to which the beach towel 10 may be imprinted. By using a transparent type thread this eliminates the need to change thread simply for color matching purposes.

The attachable type beach towel of present invention further consist of four peel and stick attaching tabs 16. These four peel and stick attaching tabs 16 will be of the hook component of the "VELCRO" type fastener. The peel and stick attaching tabs 16 are typically 25.4 mm (1") in width and have a length dimension of roughly 50.8 mm (2"). These tabs are not permanently attached to the beach towel 10 but rather they will be supplied. The peel and stick attaching tabs 16 will have an adhesive backing with a peel off protective cover, which will be removed to expose the adhesive backing, so as to be adhered to the seating apparatus in the appropriate location as required to correspond with the attaching straps 12.

OPERATION—FIGS. 2A, 2B, 2C, 3A, 3B, 4A, 4B

Figures 2A, 2B, 2C:
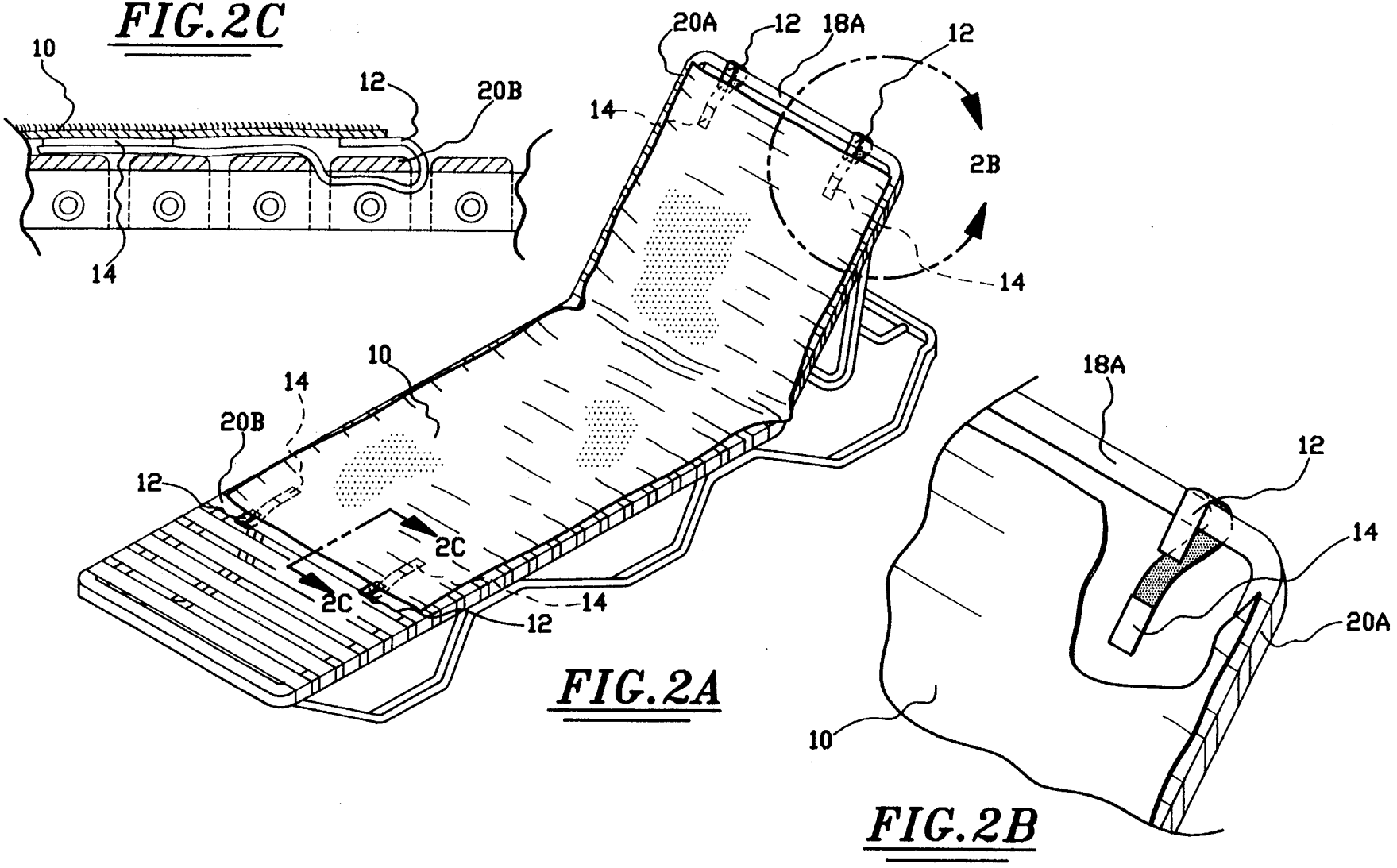
FIGS. 2A to 2C shows the attachable type beach towel as it is applied to a lounge chair and the like, type seating apparatus.

The manner in which the attachable type beach towel of present invention is secured to a lounge chair type seating apparatus (FIG. 2A) and the like, is first to determine which end of the beach towel 10 will be at the head end of the chair (this is usually determined by the design imprinted on the towel, otherwise it is irrelevant as to the attachment function of the towel which end goes towards the head or towards the feet end of the seating apparatus). The towel is then laid out on the chair in which it is to be attached to. The two attaching straps 12 at the head end of the lounge chair type seating apparatus are then wrapped around the upper horizontal rail 18A of the chair frame and then inserted back through the opening between the upper horizontal rail 18A and the first body support strap 20A that is parallel to the upper horizontal rail 18A. The attaching strap 12 is then joined with its corresponding attaching tab 14 utilizing the entire surface of the tab (FIG. 2B). The two attaching straps 12 at the foot end of the chair are then wrapped around the body support strap 20B that is closest to the end of the foot end of the beach towel 10 while the towel is laying against the chair taking on the general configuration of the seating apparatus it is being attached to. The attaching strap 12 is then inserted back through the opening between the body support strap 20B that it is wrapped around and the next strap that is parallel with it in the direction of the head end of the seating apparatus. The attaching strap 12 is then joined with its corresponding attaching tab 14 utilizing the entire surface of the tab (FIG. 2C).

Figure 3B:
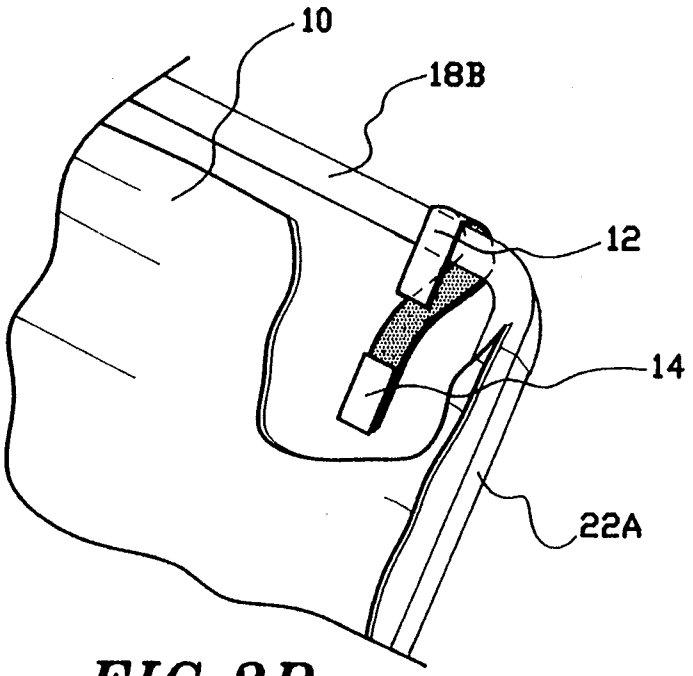
FIGS. 3A and 3B shows the attachable type beach towel as it is applied to a deck chair and the like, type seating apparatus.
Figure 3A:
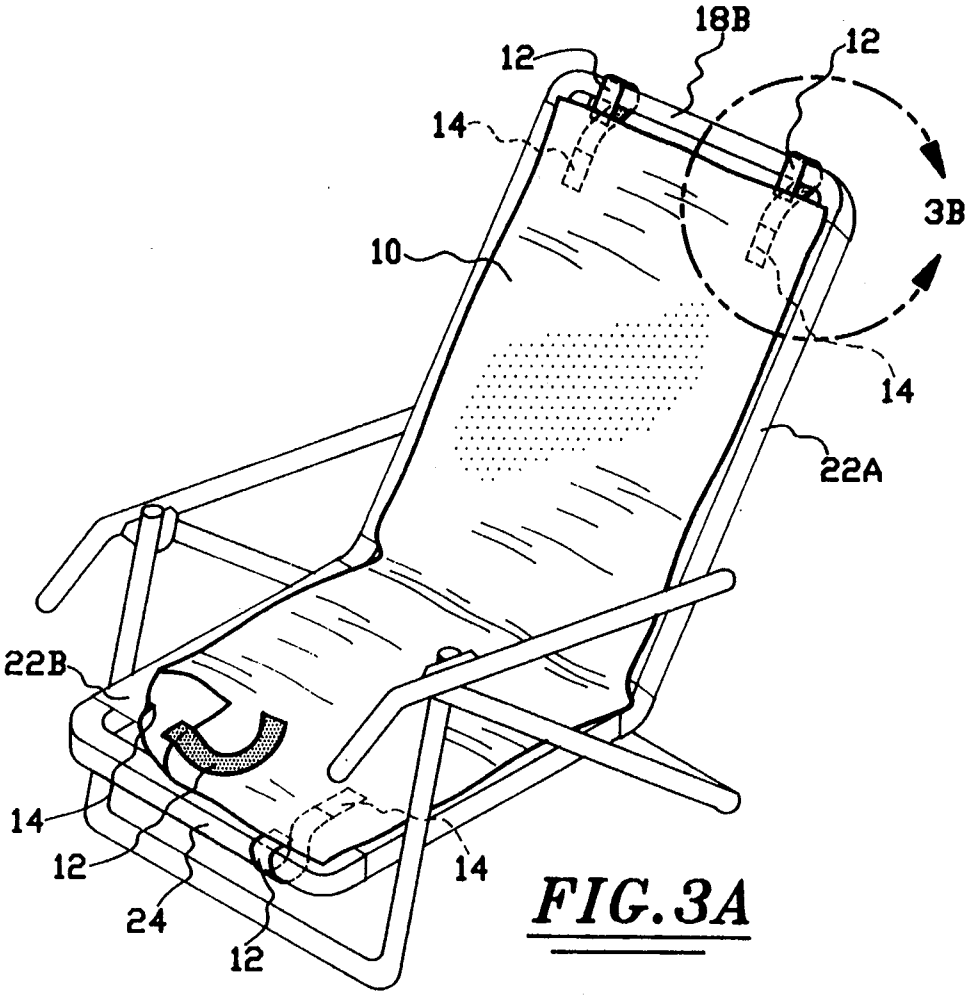

The manner in which the attachable type beach towel of present invention is secured to a deck chair type seating apparatus (FIG. 3A) and the like, is determine which end of the beach towel 10 will go towards the head end of the chair. The towel is then laid out on the chair it is to be attached to. The two attaching straps 12 at the head end of the deck chair type seating apparatus are then wrapped around the upper horizontal rail 18B of the chair frame and then inserted back through the opening between the upper horizontal rail 18B and the body support panel 22A. The attaching strap 12 is then joined with its corresponding attaching tab 14 utilizing the entire surface of the tab (FIG. 3B). The procedure for attaching the foot end of the attachable type beach towel to the foot end of the deck chair type seating apparatus and the like is to wrap the attaching straps 12 around the lower horizontal rail 24 of the chair frame the straps are then inserted back through the opening between the lower horizontal rail 24 and the body support panel 22B. The attaching strap 12 is then joined with its corresponding attaching tab 14 utilizing the entire surface of the tab.

Figure 4B:
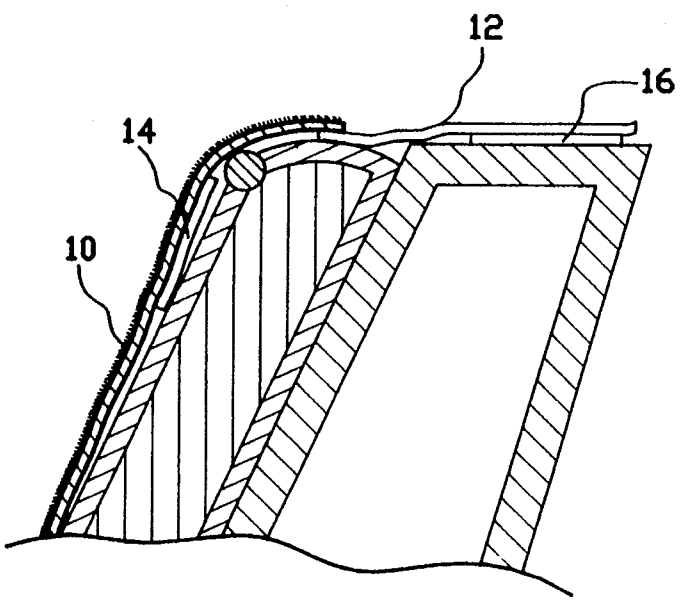
FIGS. 4A and 4B shows the attachable type beach towel as it is applied to strapless type seating such as boat seats and the like using the "VELCRO" type corresponding peel and stick attaching tabs.
Figure 4A:
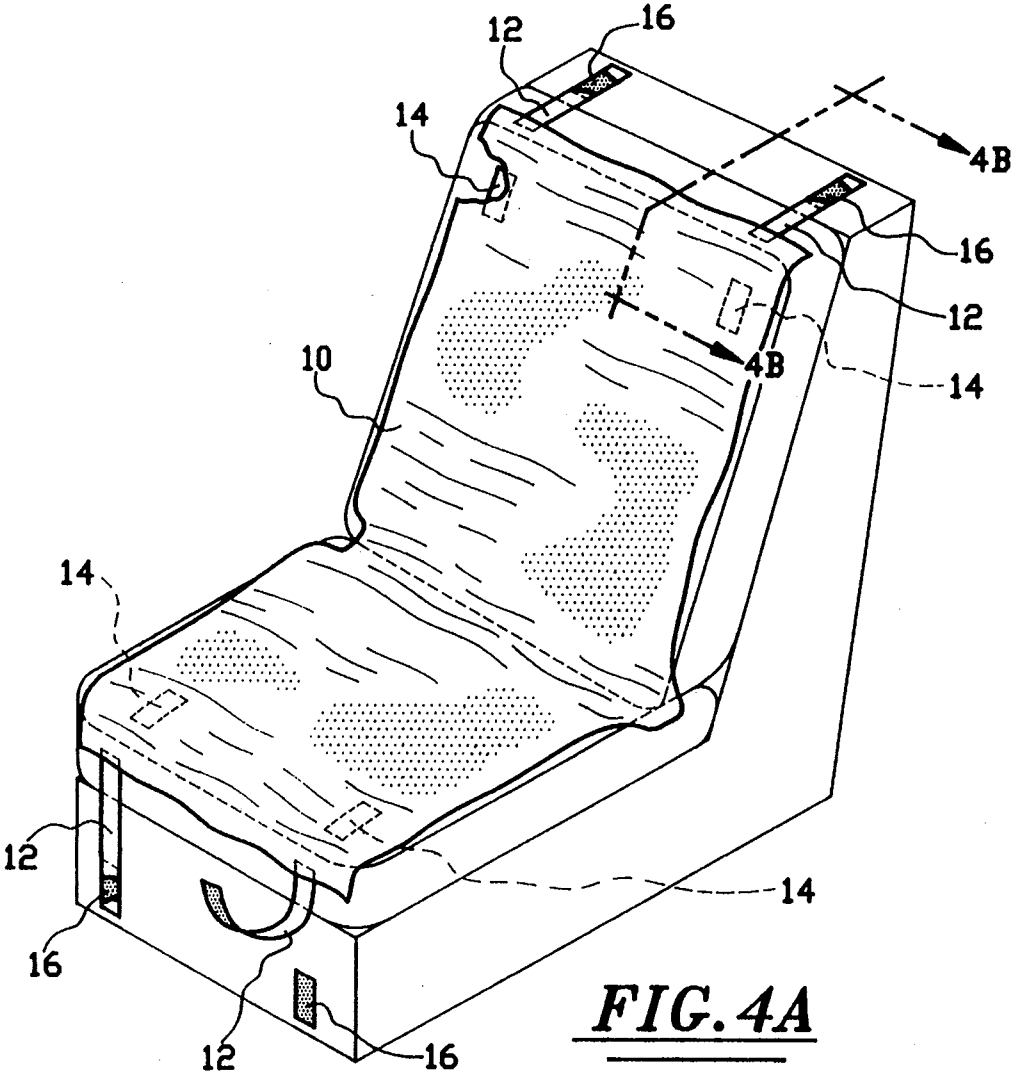

The manner in which the attachable type beach towel of present invention is secured to a boat seat type seating apparatus (FIG. 4A) and the like, (the type seating to which there is no chair frame or body support straps and or panels to attach to) is determined which end of the beach towel 10 will go towards the head end of the seat. The towel is then laid out on the seat it is to be attached to. The two attaching straps 12 at the head end of the boat seat type seating apparatus are extended out from the end to which they are permanently attached to the beach towel 10. Once the attaching straps 12 are extended out onto the seating apparatus at the head end, this will give the user of the attachable type beach towel the appropriate location in which to apply the corresponding peel and stick attaching tabs 16 (the tabs can be applied to the seating apparatus anywhere along the length of the attaching straps). To apply the peel and stick attaching tabs 16 the seating apparatus must be wiped clean of all dirt and oil that may be present in the areas that the peel and stick attaching tabs 16 will be applied. The cleaning of these areas should be done using a soap or cleaning solvent that would be appropriate for this type of cleaning. Once the areas where the peel and stick attaching tabs 16 will be applied are cleaned the backing on the tabs can then be removed exposing the adhesive backing, the tabs are then applied to the appropriate locations that have been determined by the location of the extended attaching straps 12 on the seating apparatus. The location of the corresponding peel and stick attaching tabs 16 should be located so that the entire surface of the peel and stick attaching tab 16 is utilized by the attaching strap 12 (FIG. 4B). To attach the foot end of the beach towel 10 to the foot end of the boat seat type seating apparatus is the same as attaching the head end in that the attaching straps 12 at the foot end are extended out from the end to which they are permanently attached to the beach towel 10. Once the attaching straps 12 are extended out onto the seating apparatus at the foot end, this will give the appropriate location in which to apply the corresponding peel and stick attaching tabs 16 (the tabs can be applied to the seating apparatus anywhere along the length of the attaching straps). To apply the peel and stick attaching tabs 16 the seating apparatus must be wiped clean of all dirt and oil that may be present in the areas that the peel and stick attaching tabs 16 will be applied. Once these areas are cleaned the backing on the tabs can then be removed exposing the adhesive backing, the tabs are then applied to the appropriate locations that have been determined by the location of the extended attaching straps 12 on the seating apparatus. The location of the corresponding peel and stick attaching tabs 16 should be located so that the entire surface of the peel and stick attaching tab 16 is utilized by the attaching strap 12.

SUMMARY, RAMIFICATION, AND SCOPE

Accordingly, the reader will see that the attachable type beach towel of this invention can be used in a variety of applications easily and conveniently and with minimal instruction, the towel is just as easily removed from the seating apparatus it is applied to in the event it is needed to dry off or be moved to another location or type of seating apparatus. In addition to the simplicity of use, the design itself requires no special or time consuming manufacturing processes by which the cost may be affected in a manner that would not be appealing to the consumer.

Furthermore the attachable type beach towel has the additional advantages in that:

- it can be used in all the same manners in which a conventional non-attachable type beach towel is used as there are no bulky attaching components to deal with, if the user happened to be at a beach and chose to lay the towel out in the sand the attaching straps would simply be connected to their corresponding attaching tabs rendering them out of use and out of site;
- there are no limiting restrictions as to the shape and size of the beach towel component of the attachable type beach towel, as the attaching components do not rely on a specific shape or size for their attaching capabilities to function;
- the beach towel component of the attachable type beach towel can be manufactured in a unlimited variety of colors and designs, the attaching components also come in a variety of colors in which they can be matched to the colors imprinted on the beach towel;

Although the description above contains many specifications, these should not be construed as limiting the scope of the invention but as merely providing illustrations of some of the presently preferred embodiments of this invention. Thus the scope of the invention should be determined by the appended claims and their legal equivalents, rather than by examples given.

I claim:

1. A beach towel package for universal use, comprising:

(a) a main body portion of towel material, said main body portion being of a predetermined elongated substantially rectangular shaped moisture absorbent fabric having a pair of side edges and a pair of ends wherein each of the pair of ends has attached thereto a plurality of elongated attaching straps; wherein the plurality of elongated attaching straps each have two ends and one end of each provides permanent attachment to the main body portion, and wherein located adjacent to and corresponding with said plurality of attaching straps are a plurality of elongated attaching tabs permanently attached to said main body portion, said plurality of attaching straps and plurality of elongated attaching tabs being mating components of a hook and loop fastening means; and (b) a plurality of elongated peel and stick attaching tabs capable of being applied to a seating apparatus when subsequently needed for attachment of said plurality of attaching straps to said seating apparatus.

2. The beach towel package of claim 1, wherein said attaching straps are of generally equal length and width and are located at said pair of ends of the main body portion and spaced inwardly from said pair of side edges.

3. The beach towel package of claim 2, wherein said attaching straps are located on opposite sides of a central axis parallel to said pair of side edges of said main body portion.

4. The beach towel package of claim 3, wherein said attaching straps are of the loop component portion of said hook and loop fastening means.

5. The beach towel package of claim 1, wherein said attaching tabs are of generally equal length and width.

6. The beach towel package of claim 5, wherein said attaching tabs are of the hook component portion of said hook and loop fastening means.

7. The beach towel package of claim 1, wherein said plurality of said elongated peel and stick attaching tabs are of generally equal length and width.

8. The beach towel package of claim 7, wherein said elongated peel and stick attaching tabs are of said hook component portion of said hook and loop fastening means.

* * * * *